US005528343A

United States Patent [19]

Tada et al.

[11] Patent Number: 5,528,343

[45] Date of Patent: Jun. 18, 1996

[54] DRIVING CARTRIDGE FOR AN IMAGE FORMING APPARATUS

[75] Inventors: Hideki Tada; Hisayoshi Kojima; Masanori Yamagata, all of Yokohama; Toshiki Nagase, Hoya; Akira Ito, Tokyo; Mitsugu Inomata, Kawasaki, all of Japan

[73] Assignee: Canon Kabushiki Kaisha, Tokyo, Japan

[21] Appl. No.: 372,834

[22] Filed: Jan. 13, 1995

Related U.S. Application Data

[63] Continuation of Ser. No. 84,431, Jun. 30, 1993, abandoned, which is a continuation of Ser. No. 751,964, Aug. 29, 1991, abandoned.

[30] Foreign Application Priority Data

Aug. 31, 1990 [JP] Japan ..... 2-228415

[51] Int. Cl.[6] ..... G03G 21/16

[52] U.S. Cl. ..... 355/200; 310/83; 355/210; 355/326 R

[58] Field of Search ..... 355/210, 200, 355/326 R, 327; 310/83, 89; 474/84, 134

[56] References Cited

U.S. PATENT DOCUMENTS

| | | | |
|---|---|---|---|
| 4,563,078 | 1/1986 | Fantuzzo et al. | 355/200 |
| 4,994,853 | 2/1991 | Fukuchi et al. | 355/327 X |
| 4,996,566 | 2/1991 | Morita et al. | 355/326 X |
| 5,103,261 | 4/1992 | Matsuo et al. | 355/200 X |
| 5,124,747 | 6/1992 | Haneda et al. | 355/200 |
| 5,132,732 | 7/1992 | Kalyandurg et al. | 355/326 X |
| 5,172,165 | 12/1992 | Hatakeyama et al. | 355/326 X |
| 5,208,612 | 5/1993 | Obu et al. | 355/200 X |

FOREIGN PATENT DOCUMENTS

| | | |
|---|---|---|
| 0314536 | 3/1989 | European Pat. Off. . |
| 0371758 | 6/1990 | European Pat. Off. . |
| 0381518 | 8/1990 | European Pat. Off. . |
| 60-166968 | 8/1985 | Japan . |
| 62-127761 | 6/1987 | Japan . |
| 1-179168 | 7/1989 | Japan . |
| 2-304576 | 12/1990 | Japan . |
| 2177976 | 2/1987 | United Kingdom . |

*Primary Examiner*—Joan H. Pendegrass
*Assistant Examiner*—Nestor R. Ramirez
*Attorney, Agent, or Firm*—Fitzpatrick, Cella, Harper & Scinto

[57] ABSTRACT

An image forming apparatus having a cartridge includes an image forming device acting on an image bearing member and a driving force transmitting device which is adapted to transmit a driving force from an apparatus side to a cartyridge side and which is separable from the image forming device. The apparatus also includes a drive source. The image forming device and the driving force transmitting device are integrally mountable to the apparatus.

8 Claims, 3 Drawing Sheets

DRIVING CARTRIDGE FOR AN IMAGE FORMING APPARATUS

This application is a continuation of application Ser. No. 08/084,431 filed Jun. 30, 1993, which is a continuation of application Ser. No. 07/751,964 filed Aug. 29, 1991, both now abandoned.

BACKGROUND OF THE INVENTION

1. Field of the Invention

The present invention relates to an image forming apparatus such as a copying machine, printer and the like having a cartridge, and more particularly it relates to a color image forming apparatus.

2. Related Background Art

Recently, in many applications for image forming apparatuses such as an electrophotographic color copying machine, color printer and the like, a plurality (for example four—yellow color (Y), magenta color (M), cyan color (C) and black color (BK)) of developing devices have been disposed around an electrophotographic photosensitive drum. During the formation of a color image, these developing devices are sequentially driven as the photosensitive drum is rotated, so that an electrostatic latent image on the photosensitive drum is developed with each color toner. Thereafter, the developed image is transferred onto a sheet.

By the way, it has been requested that such color image forming apparatus should also be made small-sized and have easy maintenance. To meet such requirement, the technique in which the process elements such as a photosensitive drum, developing device and the like are contained in a cartridge, which was usually used with a monochromatic-color image forming system has been adapted to the color image forming apparatus, thereby permitting easy maintenance by changing or replacing the cartridges by an operator.

FIG. 3 is an elevational sectional view of a conventional color image forming apparatus. As shown, a cartridge C is removably mounted within an image forming apparatus 110. The cartridge C has a housing 104 including a photosensitive drum 106, a cleaner having a cleaning blade 117, color developing devices 105Y, 105M, 105C, 105BK and a corona discharger 100 therein. In addition, the image forming apparatus 110 is provided with an optical system 114' for scanning with a laser beam the photosensitive drum 106 which is uniformly charged by the corona discharger 100, a sheet supply cassette 101 for supplying a plain paper as a transfer sheet, a rotatable drum 102 for holding the sheet and adapted to be rotated by several revolutions to transfer the developed images formed on the photosensitive drum 106 onto the sheet, and a fixing device 103 for thermally fixing the non-fixed toner image transferred to the sheet.

By the way, the color image forming apparatus differs from the monochromatic-color image forming system in the point that, in the color image forming apparatus, since the images are developed by a plurality of developing devices, it is necessary to prevent the mixing of colors and to develop the images with each color toner by sequentially driving one of the developing devices. Thus, in the color image forming apparatus, it is required to provide means for changing the drive of the developing devices so that, during the development with a certain color toner, only the developing device associated with such color toner is driven, but the other developing devices are not driven.

As mentioned, when the cartridge is adapted to the color image forming apparatus, although the above-mentioned drive changing means is required, the applicant has proposed a technique wherein a drive changing mechanism is arranged at the side of the image forming apparatus and the drive changing mechanism is connected to drive shafts of the developing devices when the cartridge is inserted into the apparatus, as described in the Japanese Patent Application No. 2-90395 (filed on Apr. 6, 1990).

However, in this proposed technique, since there are a plurality of connection portions between the drive shafts of the developing devices at the cartridge side and the drive changing mechanism at the apparatus side, when the cartridge is mounted within the apparatus, the positioning of the connection portions will be complicated, with the result that it is very hard to correctly position the connection portions only by the insertion of the cartridge into the apparatus.

On the other hand, the conventional cartridge is generally provided with a driving force transmitting means such as gears, belts and the like for transmitting a driving force to the photosensitive drum and the developing devices disposed within the cartridge. It is also true regarding the monochromatic-color cartridge having only one developing device. Such driving force transmitting means has a considerably longer service life than the consumption of the toner in the cartridge and the service life of the photosensitive drum (due to the fatigue thereof), since it has less wear and fatigue damage. However, in the conventional method wherein the driving force transmitting means is replaced and disposed together with the replacement and disposal of the cartridge, since the part (driving force transmitting means) which should not yet be disposed is replaced, there arose a problem that the cost of the cartridge and accordingly the running cost of the apparatus was increased, thus lessening the merit of the cartridge. This problem will be further noticable in the cartridges having a plurality of driving portions and used with the color image forming apparatus.

SUMMARY OF THE INVENTION

An object of the present invention is to provide a color image forming apparatus wherein a driving force transmitting means for transmitting a driving force from an apparatus side to a cartridge side is removable relative to both the image forming apparatus and a cartridge.

Another object of the present invention is to provide a color image forming apparatus which can perform the positioning between a plurality of developing devices and a drive changing means for changing the drive of the developing devices with high accuracy.

A further object of the present invention is to provide a color image forming apparatus which can surely perform the driving of the cartridge and reduce the running cost of the apparatus.

The other objects of the present invention will be apparent from the explanation of the invention described hereinbelow.

DETAILED DESCRIPTION OF THE PREFERRED EMBODIMENTS

The present invention will now be explained in connection with embodiments thereof with reference to the accompanying drawings.

Figure 1:
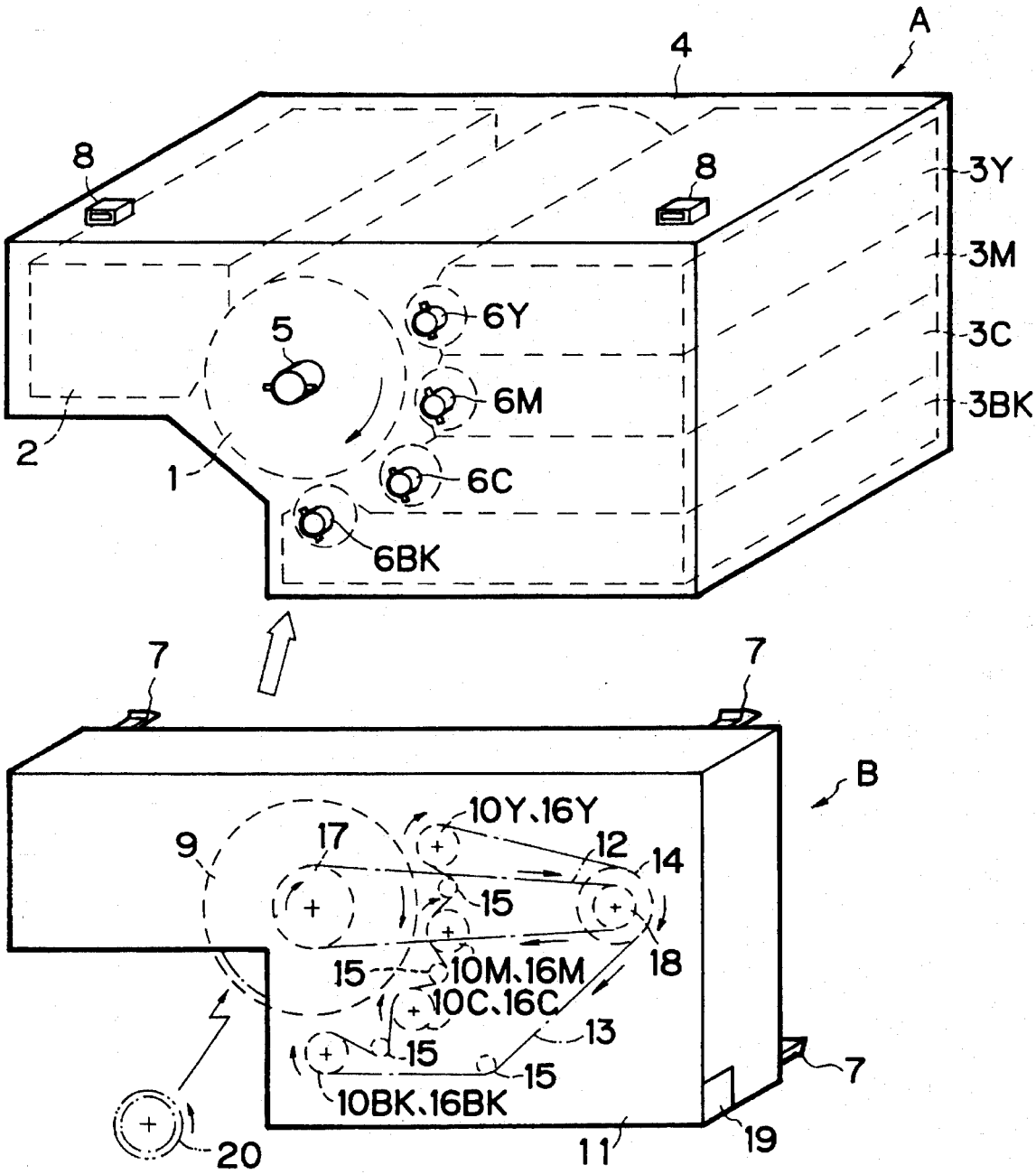
FIG. 1 is a perspective view of a cartridge and a driving force transmission changing unit, for explaining a preferred embodiment of the present invention.

FIG. 1 is an exploded perspective view showing a cartridge to be mounted on a color image forming apparatus according to the present invention and therearound. In FIG. 1, a cartridge A has a casing 4 including therein a photosensitive drum (image bearing member) 1, a cleaner 2 comprising an elastic blade slidingly contacting the drum 1, and color (yellow, magenta, cyan and black) developing devices 3Y, 3M, 3C and 3BK. A drive shaft 5 for the drum and drive shafts 6Y, 6M, 6C and 6BK for sleeves of the developing devices 3Y, 3M, 3C and 3BK are protruded from a side of the casing 4.

Incidentally, in FIG. 1, the reference symbol B denotes a driving force transmission changing unit having a drive changing means for changing the drive of the developing devices 3Y, 3M, 3C and 3BK and a driving force transmitting means for transmitting a driving force from the apparatus side to the cartridge side. The unit B can easily be mounted and dismounted with respect to the cartridge A by engaging and disengaging connection pawls 7 formed on unit B with respect to connection hole members 8 formed on the cartridge A. When the unit B is mounted on the cartridge, the drum drive shaft 5 of the cartridge is fitted into a fitting hole (not shown) formed in an output portion of a drum pulley gear 9 disposed in the unit B, and the sleeve drive shafts 6Y, 6M, 6C and 6BK are fitted into fitting holes (not shown) formed in output portions of drive changing clutches 16Y, 16M, 16C and 16BK, respectively. The unit B mounted on the cartridge can be removably mounted on the image forming apparatus together with the cartridge.

By the way, the driving force transmission changing unit B has a casing 11 including therein a relay pulley 14, a tension pulley 15, timing pulleys 17, 18 having the same rotational axes as those of the drum pulley gear 9 and the relay pulley 14, respectively, a timing belt 12 extending between the timing pulleys 17, 18, sleeve drive pulleys 10Y, 10M, 10C and 10BK constituting input portions of the drive changing clutches 16Y, 16M, 16C and 16BK, and a timing belt 13 wound around the sleeve drive pulleys 10Y, 10M, 10C and 10BK, relay pulley 14 and tension pulley 15, as well as the above-mentioned drum pulley gear 9 and the drive changing clutches 16Y, 16M, 16C and 16BK.

When the driving force transmission changing unit B is firstly connected to the cartridge A and then the cartridge is mounted on a body of the image forming apparatus (not shown), a drive transmitting portion of the drum pulley gear 9 protruded from the casing 11 is engaged by a drive transmitting gear 20 disposed at the apparatus side, with the result that the driving force is transmitted to the photosensitive drum 1 in the cartridge A and is transmitted to the timing pulley 17, timing belt 12, timing pulley 18, relay pulley 14, timing belt 13 and sleeve drive pulleys 10Y, 10M, 10C and 10BK, by means of the driving force transmitting means. Further, the unit B has an abutment portion 19 electrically connected to the image forming apparatus. In response to a signal from the abutment portion 19, the operation of the drive changing clutches (drive changing means) 16Y, 16M, 16C and 16BK is properly selected. In this way, the driving force from the apparatus side drives the photosensitive drum and the developing devices sequentially selected, thus forming the color image.

Now, the construction of the drive changing clutches and therearound will be briefly explained.

For example, the yellow developing device 3Y will be described. The drive changing clutch 16Y is disposed at the back side of the sleeve drive pulley 10Y in FIG. 1, and is designed so that it can be connected to and disconnected from the sleeve drive pulley 10Y by turning an electromagnet ON and OFF to change the driving force transmitting condition in response to a signal from the apparatus side. Further, the drive changing clutch 16Y is provided at its output portion with the fitting hole for receiving the sleeve drive shaft 6Y, so as to permit the mounting and dismounting of the driving force transmission changing unit B with respect to the cartridge and the engagement and disengagement between the fitting hole and the sleeve drive shaft 6Y, as mentioned above. This arrangement is similarly adopted to other developing devices.

In this way, in the illustrated embodiment, since the driving force transmission changing unit is firstly mounted to the cartridge while positioning the drive changing means thereof at hand and then the cartridge with the drive changing means is mounted on the image forming apparatus, it is not needed to perform the complicated positioning between the plurality of developing devices and the drive changing means, with the result that the positioning between the plurality of developing devices and the drive changing means can easily be effected with high accuracy.

Further, in the illustrated embodiment since the driving force transmission changing unit B having the driving force transmitting means and the drive changing means is formed independently from the cartridge A and can be removably mounted on the cartridge, only the cartridge may be replaced by a new one and the driving force transmitting means and the drive changing means of the driving force transmission changing unit B can be repeatedly used by the new cartridge A whenever the used-up cartridge is replaced, thus solving the problem regarding the increase in the running cost of the apparatus.

Incidentally, in the illustrated embodiment, while the drive of the plural developing devices were changed by the drive changing means, if it is necessary to change a driving portion (developing devices, photosensitive drum, cleaner and the like) in the cartridge at need, the drive changing means of the present invention can be adopted to such driving portion.

Figure 2:
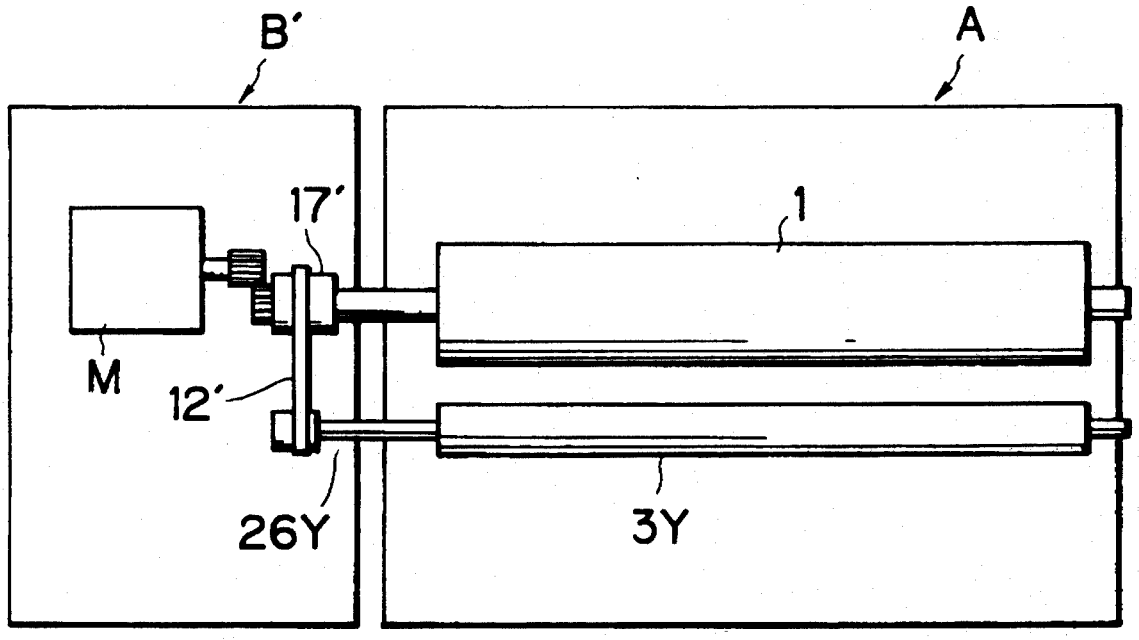
FIG. 2 is a plan view of a cartridge and a driving force transmission changing unit, for explaining another embodiment of the present invention.
Figure 3:
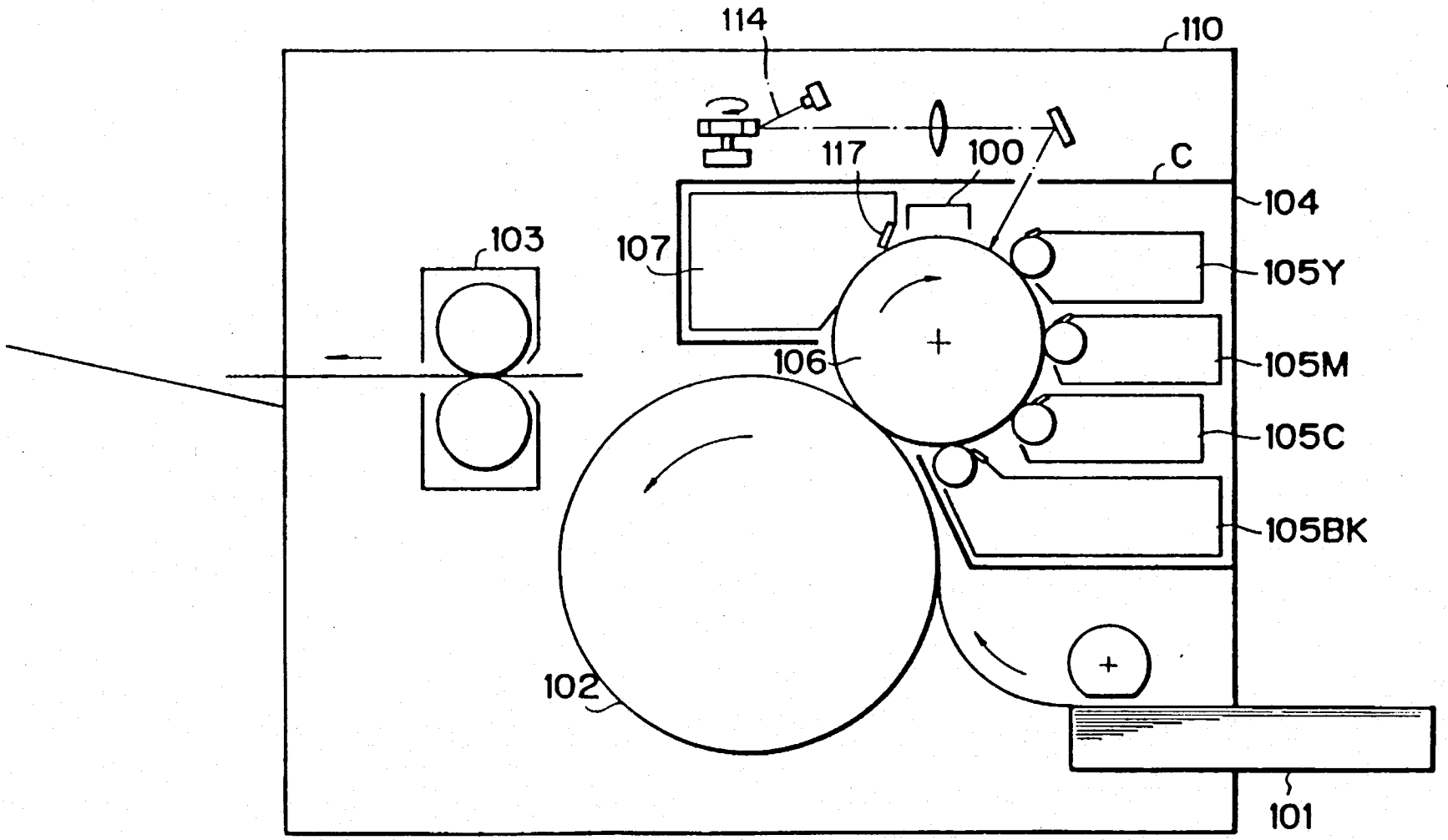
FIG. 3 (PRIOR ART)
FIG. 3 is an elevational sectional view of a conventional image forming apparatus.

Next, another embodiment of the present invention will be explained with reference to FIG. 2. FIG. 2 is a plan view of a cartridge and thereabout. In the cartridge, there are disposed a plurality of developing devices corresponding to yellow, magenta, cyan and black colors; but, in FIG. 2, only a yellow developing sleeve 3Y is shown as an example.

A driving force transmission changing unit B' according to this embodiment is generally identical to that of the previous embodiment, except that a motor M as a driving source is arranged in the driving force transmission changing unit B'. Incidentally, the reference numeral 26Y denotes a drive changing clutch similar to the above-mentioned drive changing clutch 16Y, 12' is a belt like in the previous embodiment. With this arrangement, since the cartridge A can be connected to the image forming apparatus only via the electrical contact, during the mounting of the cartridge, the positioning is further facilitated. Further, since the photosensitive drum can be directly driven by the motor M, it is possible to avoid the uneven or non-uniform rotation of the photosensitive drum 1 which would occur in the conventional technique.

Incidentally, if the photosensitive drum and the developing devices are driven by the same motor, the load fluctuation in the photosensitive drum and in the developing devices will cause the subtle irregular rotation of the motor. Thus, the photosensitive drum and the developing devices may be driven by different driving sources and these driving sources may be arranged in the driving force transmission changing unit.

Further, in the illustrated embodiments, while an example of the color cartridge was explained, in a monochromatic-color cartridge having only one developing device, the driving force transmitting means for transmitting the driving force from the apparatus side to the cartridge side may be removable with respect to both the image forming apparatus and the cartridge. In this case, an apparatus that the same advantage as the present invention is obtained.

In addition, in the illustrated embodiments, while the photosensitive drum was used as the image bearing member, other photosensitive members such as a photosensitive belt may be used.

While various embodiments were explained hereinabove, the present invention is not limited to such embodiment, and various alterations and modifications can be effected within the scope of the present invention.

What is claimed is:

1. An image forming apparatus, comprising:

a main body;

a cartridge removably mountable onto said main body, said cartridge having an image bearing member and a plurality of developing means for supplying developers to said image bearing member;

a drive motor for generating a drive force;

first drive force transmitting means for transmitting the drive force of said drive motor to said cartridge;

second drive force transmitting means provided in said cartridge for transmitting the drive force from said first drive force transmitting means to said plurality of developing means, said second drive force transmitting means being engaged with said first drive force transmitting means when said cartridge is mounted onto said main body, said second drive force transmitting means comprising a drive switching mechanism for selectively transmitting the drive force from said first drive force transmitting means to one of said plurality of developing means, wherein said cartridge includes a first casing for containing the image bearing member and the plurality of developing means therein, and a second casing for containing said second drive force transmitting means therein, said second casing being removably mounted onto said first casing.

2. An image forming apparatus according to claim 1, wherein each of said first drive force transmitting means and said second drive force transmitting means comprises a gear.

3. An image forming apparatus according to claim 1, wherein said plurality of developing means comprises different color developers.

4. An image forming apparatus according to claim 1, wherein said cartridge further comprises charging means for charging said image bearing member, and cleaning means for removing residual matter from said image bearing member.

5. An image forming apparatus according to claim 1, wherein each of said plurality of developing means comprises a developing roller for bearing the developer thereon, and said developing roller is driven by said drive motor via said first drive force transmitting means and said second drive force transmitting means.

6. A cartridge detachably mountable onto a main body of an image forming apparatus, wherein the main body of the image forming apparatus includes a drive motor provided therein, said cartridge comprising:

an image bearing member;

a plurality of developing means for supplying developer to said image bearing member;

a drive motor for generating a drive force;

first drive force transmitting means for transmitting the drive force of said drive motor to said cartridge;

second drive force transmitting means provided in said cartridge for transmitting the drive force from said first drive force transmitting means to said plurality of developing means, said second drive force transmitting means being engaged with said first drive for transmitting means when said cartridge is mounted onto said main body, said second drive force transmitting means comprising a drive switching mechanism for selectively transmitting the drive force from said first drive force transmitting means to one of said plurality of developing means, wherein said cartridge includes a first casing for containing the image bearing member and the plurality of developing means therein, and a second casing for containing said second drive force transmitting means therein, said second casing being removably mounted onto said first casing.

7. A cartridge according to claim 6, wherein each of said plurality of developing means comprises a developing roller for supplying developer to said image bearing member, said developing roller being driven by the drive motor via said drive force transmitting means.

8. A cartridge according to claim 6, further comprising charging means for charging said image bearing member and cleaning means for removing residual matter from said image bearing member.

* * * * *

UNITED STATES PATENT AND TRADEMARK OFFICE

CERTIFICATE OF CORRECTION

PATENT NO. : 5,528,343

DATED : June 18, 1996

INVENTOR(S) : HIDEKI TADA, ET AL.

It is certified that error appears in the above-indentified patent and that said Letters Patent is hereby corrected as shown below:

ON THE COVER PAGE

Item [57] ABSTRACT

Line 4, "carty-" should read --cart- --.

COLUMN 1

Line 41, "cleaner" should read --cleaner 107--; and
Line 44, "system 114′" should read --system 114--.

COLUMN 5

Line 13, "that" should read --having--.

Signed and Sealed this

Eighth Day of October, 1996

*Attest:*

BRUCE LEHMAN

*Attesting Officer*

*Commissioner of Patents and Trademarks*